US009173017B2

(12) United States Patent
Yang

(10) Patent No.: US 9,173,017 B2
(45) Date of Patent: Oct. 27, 2015

(54) CIRCUMAURAL EARPHONE AND DECORATING STRAP THEREOF

(71) Applicant: Bill Yang, Taipei (TW)

(72) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 0 days.

(21) Appl. No.: 14/340,583

(22) Filed: Jul. 25, 2014

(65) Prior Publication Data

US 2015/0030193 A1 Jan. 29, 2015

(30) Foreign Application Priority Data

Jul. 26, 2013 (CN) ..... 2013 1 0318344

(51) Int. Cl.
*H04R 25/00* (2006.01)
*H04R 1/10* (2006.01)

(52) U.S. Cl.
CPC ..... *H04R 1/105* (2013.01); *H04R 1/1041* (2013.01)

(58) Field of Classification Search
CPC ..... H04R 1/10; H04R 1/105; H04R 5/0335; H04R 2205/022; H04R 2210/10
See application file for complete search history.

(56) References Cited

U.S. PATENT DOCUMENTS

| | | | | |
|---|---|---|---|---|
| 2011/0015707 | A1* | 1/2011 | Tucker et al. | 607/90 |
| 2011/0051960 | A1* | 3/2011 | Robuchon et al. | 381/151 |
| 2011/0235819 | A1 | 9/2011 | Alden | |
| 2012/0099298 | A1* | 4/2012 | Hsu | 362/103 |

* cited by examiner

*Primary Examiner* — Tuan D Nguyen
(74) *Attorney, Agent, or Firm* — Jianq Chyun IP Office

(57) ABSTRACT

A circumaural earphone and a decorating strap thereof are provided. The circumaural earphone includes two earphone cups, a main strap, a decorating strap, a photosensitive switch, a power supplier and a light emitter. Two ends of the main strap are connected with the two earphone cups. Two ends of the decorating strap are detachably connected with the two earphone cups or the main strap. The photosensitive switch is disposed in one of the two earphone cups, the main strap or the decorating strap. The power supplier is disposed in one of the two earphone cups, the main strap or the decorating strap. The light emitter is disposed in the decorating strap and electrically connected with the power supplier through the photosensitive switch.

9 Claims, 6 Drawing Sheets

CIRCUMAURAL EARPHONE AND DECORATING STRAP THEREOF

CROSS-REFERENCE TO RELATED APPLICATION

This application claims the priority benefit of China application serial no. 201310318344.2, filed on Jul. 26, 2013. The entirety of the above-mentioned patent application is hereby incorporated by reference herein and made a part of this specification.

BACKGROUND

1. Field of the Invention

The invention is directed to an earphone and an earphone strap thereof and more particularly, to a circumaural earphone and a decorating strap thereof.

2. Description of Related Art

With the continuous progress in technology, all electronic products have been developed towards light, handy and miniaturized designs. For the sake of conveniently listening to sound information provided by electronic products without disturbing other people around, people may use miniaturized electronic products, such that an earphone has become a necessary accessory to the electronic product. Moreover, the earphone also provides a listener with better audio transmission so that the listener can clearly hear and understand content of the audio information. In contrast to unclear audio transmission through the air, especially when the listener is moving, for example like doing exercises, driving, intensely moving around or being in a noisy environment, the audio transmission of the earphone still would not be affected.

Among various types of earphones, circumaural earphones can provide a comfortable wearing feeling and excellent sound quality, and thus become a users' favorite earphone type. FIG. 1 is a schematic view of a conventional circumaural earphone. With reference to FIG. 1, a circumaural earphone 10 including two earphone cups 12 and a strap 14 is provided in US Patent Publication No. 2011/0235819. Each of the two ends of the strap 14 has a hooking clamp 14A. By using the hooking clamps 14A, the two ends of the strap 14 can detachably hook the two earphone cups 12. Therefore, the user can change the strap 14 according to different preferences and requirements. However, once the strap 14 is lost when it is detached and replaced by the user, the earphone cups 12 will be not able to be fixedly worn at the ears of the user anymore, and it may cause inconvenience to the user during using.

SUMMARY

The invention provides a circumaural earphone which can resolve the issue that the convention earphone cannot have both aesthetics and practicality.

The invention provides a decorating strap of a circumaural earphone which can resolve the issue of unchangeable appearance of the conventional earphone.

The invention is directed to a circumaural earphone including two earphone cups, a main strap, a decorating strap, a photosensitive switch, a power supplier and a light emitter. Two ends of the main strap are connected with the two earphone cups. Two ends of the decorating strap are detachably connected with the two earphone cups or the main strap. The photosensitive switch is disposed on one of the two earphone cups, the main strap or the decorating strap. The power supplier is disposed on one of the two earphone cups, the main strap or the decorating strap. The light emitter is disposed on the decorating strap and electrically connected with the power supplier through the photosensitive switch.

The invention is directed to a decorating strap of a circumaural earphone, which includes a decorating strap, a photosensitive switch, a power supplier and a light emitter. Two ends of the decorating strap are employed to be detachably connected with two earphone cups or a main strap of a circumaural earphone. The photosensitive switch is disposed on the decorating strap. The power supplier is disposed on the decorating strap. The light emitter is disposed on the decorating strap and electrically connected with the power supplier through the photosensitive switch.

In an embodiment of the invention, both the circumaural earphone and the decorating strap further include a manual switch, where the photosensitive switch is electrically connected with the power supplier through the manual switch.

In an embodiment of the invention, both the circumaural earphone and the decorating strap further include a manual switch, where the light emitter is electrically connected with the power supplier through the manual switch.

In an embodiment of the invention, the light emitter is an electroluminescent element or a light-emitting diode (LED).

In an embodiment of the invention, the power supplier of the circumaural earphone is disposed on one of the earphone cups, and connection between the decorating strap of the circumaural earphone and the earphone cups or connection between the decorating strap of the circumaural earphone and the main strap forms electrical connection between the light emitter and the power supplier.

In an embodiment of the invention, sensitivity of the photosensitive switch is adjustable.

In view of the earphone of the invention described above, the circumaural earphone has the main strap so as to be fixed on the head of a user and has the detachable decorating strap so as to have both practicality and aesthetics. The decorating strap further has the light emitter disposed thereon, so as to have both aesthetics and security and bring changeability to the appearance of the earphone.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
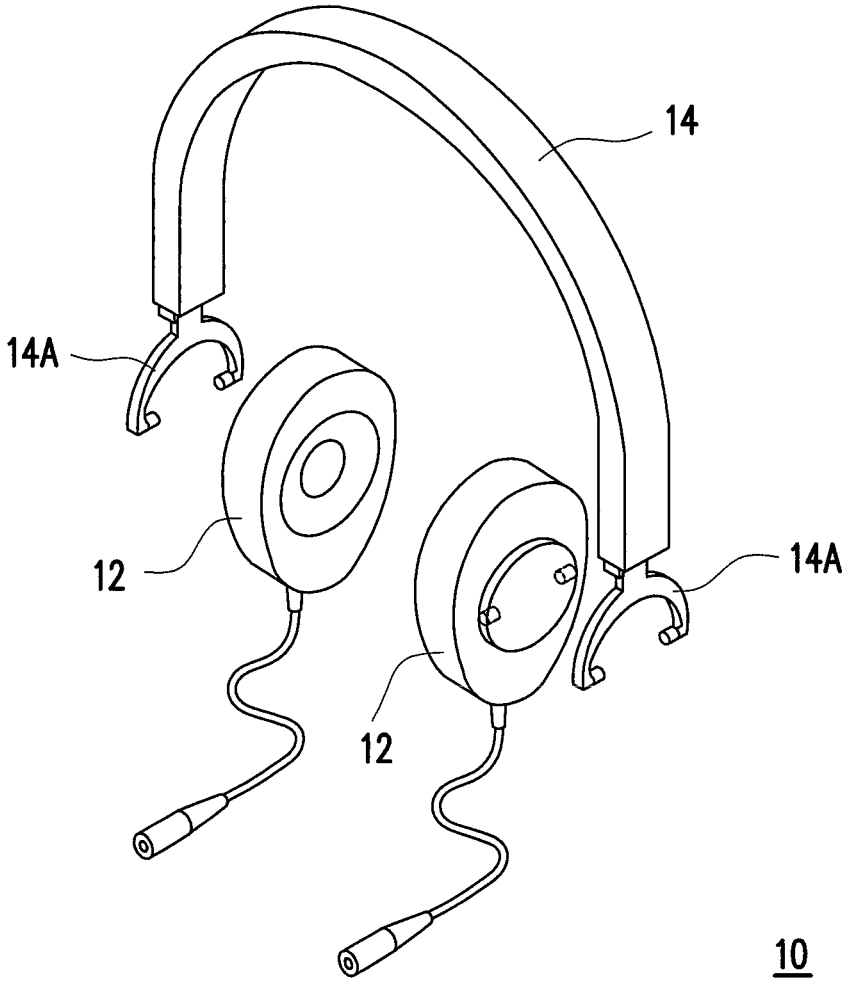
FIG. 1 (PRIOR ART)
FIG. 1 is a schematic diagram of a conventional circumaural earphone.
Figure 2:
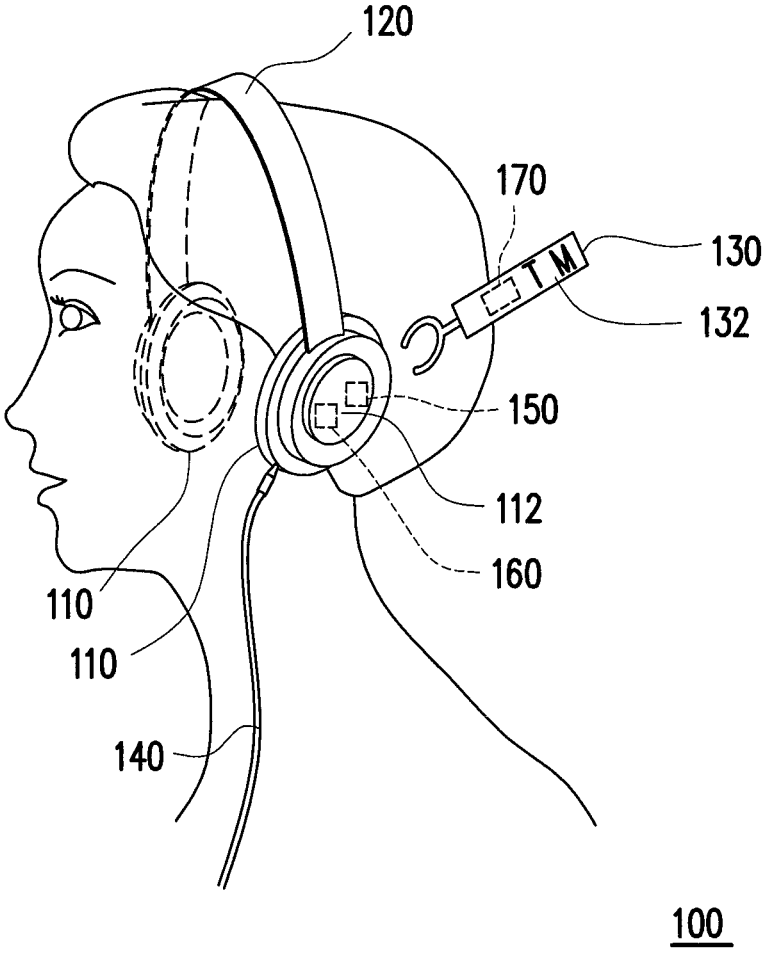
FIG. 2 is an explosive diagram of a circumaural earphone according to an embodiment of the invention.

FIG. 2 is an explosive diagram of a circumaural earphone according to an embodiment of the invention. With reference to FIG. 2, a circumaural earphone 100 of the present embodiment includes two earphone cups 110, a main strap 120, a decorating strap 130, a photosensitive switch 150, a power supplier 160 and a light emitter 170. Two ends of the main strap 120 are connected to the two earphone cups 110. Specifically, the main strap 120 and the earphone cups 110 are undetachably connected with each other, and thus, an issue that the main strap 120 is lost after the main strap 120 is detached will not occur. Therefore, the main strap 120 may provide appropriate support any time, such that the two earphone cups 110 can be attached to ears of a user to provide sounds. Certainly, a rotatable or a translatable design can be adopted between the main strap 120 and the earphone cups 110 based on demands. Additionally, the two earphone cups 110 may be respectively connected to an audio device by two audio lines (not shown), or alternatively, it may be only one of the earphone cups 110 connected to the audio device by a single audio line 140, and after that, the audio is transmitted to the other earphone cup 110 through the main strap 120. Alternatively, the circumaural earphone 100 may also be a wireless earphone. A speaker unit is installed inside an appearance member of each of the earphone cups 110.

Two ends of the decorating strap 130 are detachably connected with the two earphone cups 110. In this way, the user may change the decorating strap 130 with occasions and moods as a part of his/her personal style. Meanwhile, if the two ends of the decorating strap 130 are designed as being rotatably connected with the two earphone cups 110, the user can rotatably place the decorating strap 130 in any place, such as at the back of the head or forehead, according his/her preference, which significantly increases commercial values for the circumaural earphone 100 of the present embodiment. The decorating strap 130 may be painted with a mark 132, any letters or patterns. Additionally, the decorating strap 130 may be made of a material having better flexibility. As such, when the decorating strap 130 is connected with the two earphone cups 110, the decorating strap 130 may provide force to tightly press and attach the earphone cups 110 to the ears of the user for better acoustic fidelity.

In the present embodiment, the photosensitive switch 150 and the power supplier 160 are disposed on one of the earphone cups 110, and the light emitter 170 is disposed on the decorating strap 130 and electrically connected to the power supplier 160 through the photosensitive switch 150. In a scenario where luminance of external light sensed by the photosensitive switch 150 is sufficient, the photosensitive switch 150 keeps the light emitter 170 being disconnected from the power supplier 130. Thus, the light emitter 170 is incapable of obtaining power supplied by the power supplier 160 and does not emit light. In a scenario where the luminance of the external light sensed by the photosensitive switch 150 is insufficient, the photosensitive switch 150 induces conduction between the light emitter 170 and the power supplier 160. Thus, the light emitter 170 can obtain the power supplied by the power supplier 160 to emit light. In this way, the light emitter 170 on the circumaural earphone 100 can emit light or be turned off automatically according to the change of the ambient luminance, so as to not only provide the user of the circumaural earphone 100 with caution light in a dim environment, but also to be used for the appearance style of the user.

As described above, the two ends of the decorating strap 130 are detachably connected with the two earphone cups 110. In the meantime, the photosensitive switch 150 and the power supplier 160 are disposed on one of the earphone cups 110, and the light emitter 170 is disposed on the decorating strap 130. Thus, the light emitter 170 can be electrically connected with the photosensitive switch 150 and the power supplier 160 only when the decorating strap 130 is connected with the earphone cups 110. To achieve the structure above, corresponding terminals are disposed at places where the decorating strap 130 and the earphone cup 110 are connected with each other to serve as a path for the electrical connection. The light emitter 170 may also be formed as a decoration pattern for a decoration effect of the decorating strap 130.

In the present embodiment, the light emitter 170 may be an electroluminescent element or a light emitting diode (LED), the power supplier 160 may be a battery storing electricity, a solar cell or an element obtaining power from a player connected with the circumaural earphone 100, and the photosensitive switch 150 may adopt a photosensitive switch with adjustable sensitivity, so as to conform to usages of different users.

Other embodiments will be illustrated as follows. It should be mentioned that element labels and portions of the previous embodiments are referenced hereinafter, and the same or similar elements are indicated by the same or similar reference labels. The descriptions of the same technical details are therefore not repeated. The parts omitted from description may be referenced from the afore-described embodiments and are not repeated in the embodiments below.

Figure 3:
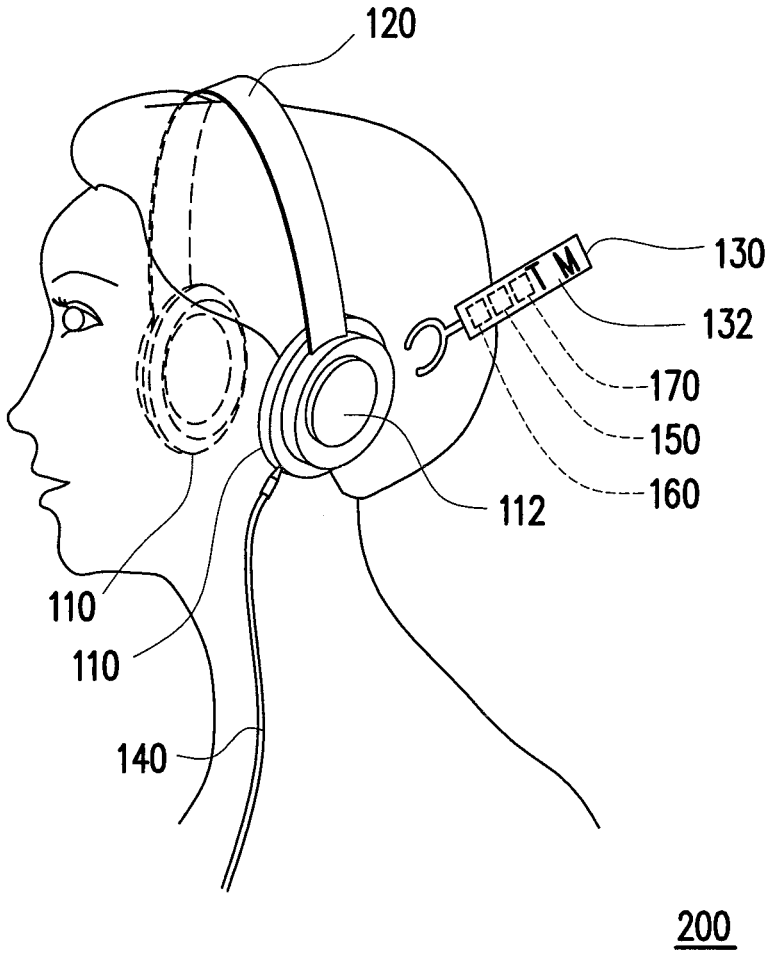
FIG. 3 is a schematic diagram of a circumaural earphone according to yet another embodiment of the invention.

The invention is not intended to limit that the photosensitive switch and the power supplier can only be disposed on one of the earphone cups. The photosensitive switch may be disposed on the main strap or the decorating strap, the power supplier may also be disposed on the main strap or the decorating strap, and the photosensitive switch and the power supplier may be disposed on different elements. FIG. 3 is a schematic diagram of a circumaural earphone according to yet another embodiment of the invention. With reference to FIG. 3, a circumaural earphone 200 of the present embodiment is similar to the circumaural earphone 100 illustrated in FIG. 2 and different therefrom in that the light emitter 170, the photosensitive switch 150 and the power supplier 160 are all disposed on the decorating strap 130 in the present embodiment. Referring to FIG. 3, since the light emitter 170, the photosensitive switch 150 and the power supplier 160 are all disposed on the decorating strap 130, the decorating strap 130 together with the light emitter 170, the photosensitive switch 150 and the power supplier 160 disposed thereon can serve as a solely sold earphone decorating strap. Thereby, consumers can even optionally purchase earphone decorating straps having different colors, patterns, appearances or light-emitting mechanisms to fit their own earphones.

Figure 4:
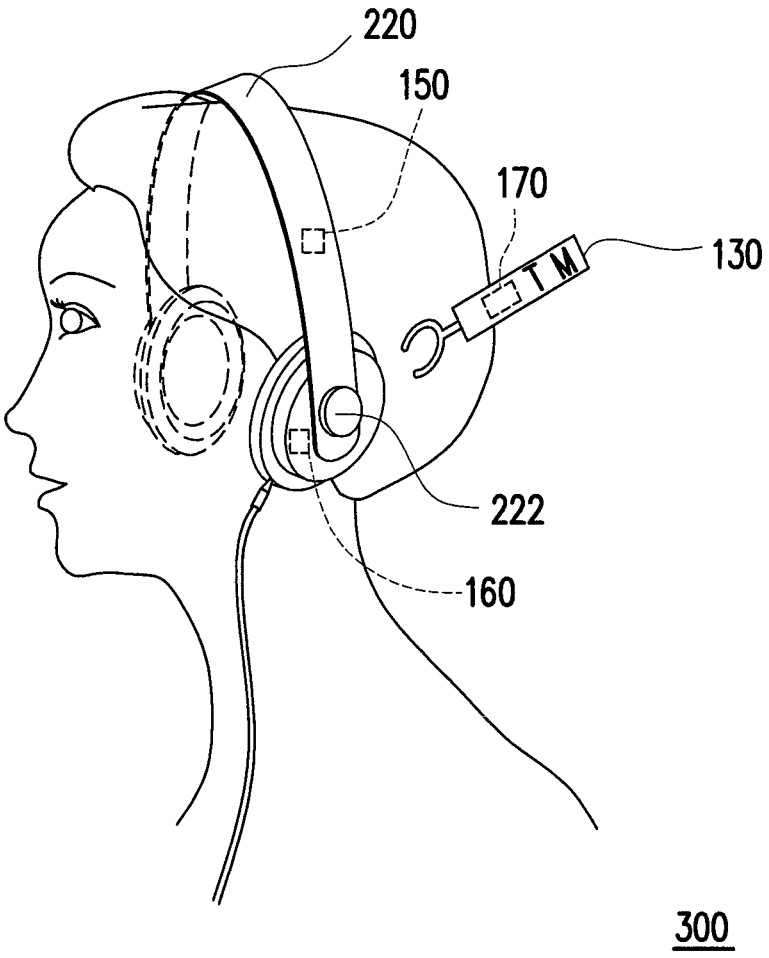
FIG. 4 is a schematic diagram of a circumaural earphone according to still another embodiment of the invention.

FIG. 4 is a schematic diagram of a circumaural earphone according to still another embodiment of the invention. With reference to FIG. 4, a circumaural earphone 300 of the present embodiment is similar to the circumaural earphone 100 illustrated in FIG. 2 and different therefrom in that the two ends of the decorating strap 130 are detachably connected with the main strap 220 (e.g., the two ends of the decorating strap 130 are pivoted to two shafts 222 at two ends of the main strap 220) in the present embodiment. Similar to the circumaural earphone 100 illustrated in FIG. 2, the decorating strap 130 of the earphone 300 of the present embodiment may be rotatably placed in any place, and the user may change the decorating strap 130 with occasions and moods as a part of his/her personal style. Additionally, in the present embodiment, the photosensitive switch 150 is disposed on the main strap 220, and the power supplier 160 is disposed on one of the earphone cups 110.

Figure 5:
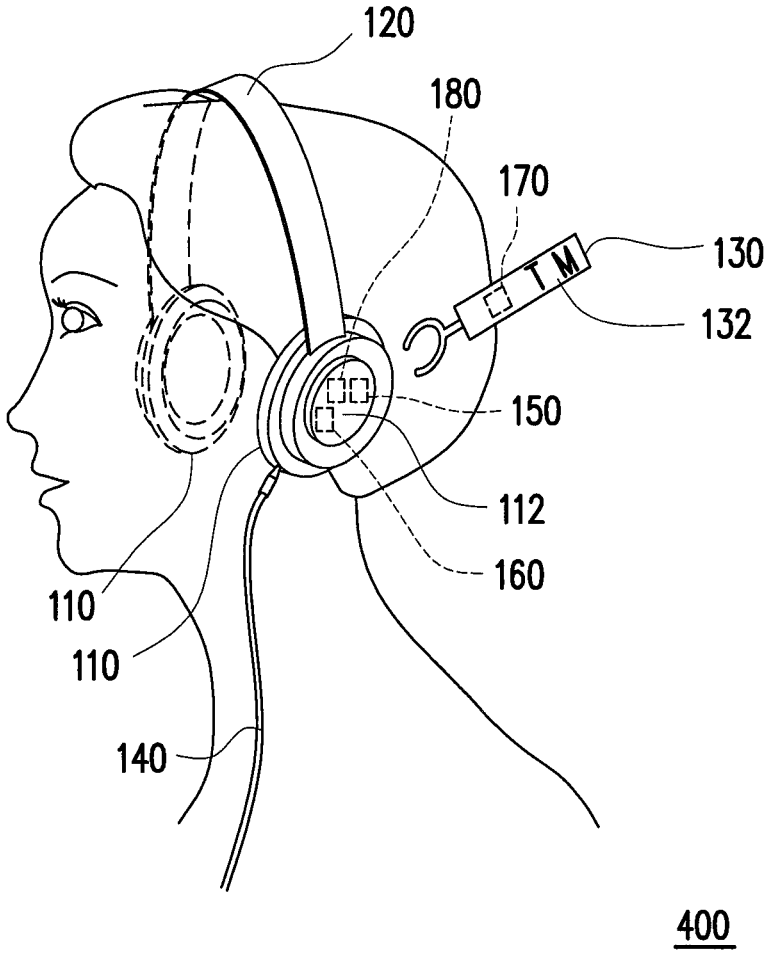
FIG. 5 is a schematic diagram of a circumaural earphone according to further another embodiment of the invention.
Figure 6A:
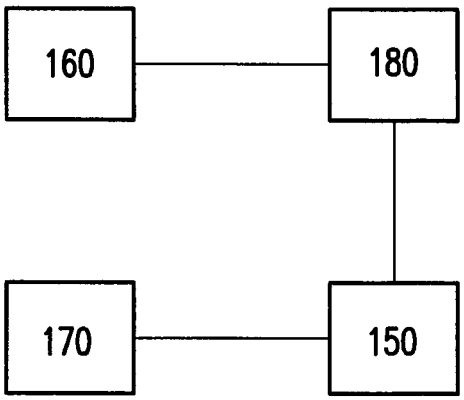
FIG. 6A and FIG. 6B are schematic diagrams illustrating electrical connection of part of the elements of the circumaural earphone depicted in FIG. 5.
Figure 6B:
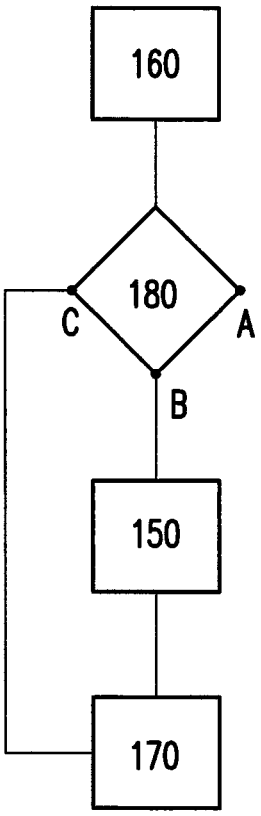

FIG. 5 is a schematic diagram of a circumaural earphone according to further another embodiment of the invention, and FIG. 6A and FIG. 6B are schematic diagrams illustrating electrical connection of part of the elements of the earphone depicted in FIG. 5. With reference to FIG. 5, a circumaural earphone 400 of the present embodiment is similar to the circumaural earphone 100 illustrated in FIG. 2 and different therefrom in that the earphone 400 further includes a manual switch 180. The photosensitive switch 150 may be electrically connected with the power supplier 160 through the manual switch 180 (as shown in FIG. 6A). Through the manual switch 180, the user may select whether to activate the light emitter 170 by the photosensitive switch 150, such that the user may select a mode for use according to the occasion. Alternatively, the light emitter 170 may be electrically with the power supplier 160 through the manual switch 180 (as shown in FIG. 6B). The manual switch 180 illustrated in FIG. 6B is a three-stage switch. When the manual switch 180 is switched to an output terminal A, the power supplied by the power supplier 160 is incapable of being output to the light emitter 170 or the photosensitive switch 150. When the manual switch 180 is switched to an output terminal B, the power supplier 160 is conducted with the photosensitive switch 150 through the manual switch 180 and activates the light emitter 170 according to a result of the photosensitive switch 150 sensing the ambient luminance. When the manual switch 180 is switched to an output terminal C, the power supplied by the power supplier 160 may be directly output to the light emitter 170 through the manual switch 180, such that the light emitter 170 is maintained in the light-emitting state. Therefore, the user may select to directly conduct the light emitter 170 with the power supplier 160 by employing the manual switch 180. In other words, the user may keep the light emitter 170 in the light-emitting state through the manual switch 180. The manual switch may also be applied to the earphone decorating strap, which is composed of the decorating strap 130 together with the light emitter 170, the photosensitive switch 150 and the power supplier 160 on the decorating strap 130, as illustrated in FIG. 3.

To sum up, in the invention, the decorating strap of the circumaural earphone is detachably connected with the earphone cups and thus, can be replaced and rotate to any place that is comfortable for the user. Meanwhile, in the circumaural earphone of the invention, the main strap remain undetachable, such that the whole circumaural earphone can be fixed on the head of the user, which has both practicality and aesthetics. Moreover, in the circumaural earphone of the invention, the light emitter is disposed on the decorating strap, which has both aesthetics and security.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A circumaural earphone, comprising:

two earphone cups;

a main strap, having two ends connected with the earphone cups;

a decorating strap, having two ends detachably connected with the earphone cups or the main strap;

a photosensitive switch, disposed on one of the earphone cups, the main strap or the decorating strap;

a manual switch, wherein the photosensitive switch is electrically connected with the power supplier through the manual switch;

a power supplier, disposed on one of the earphone cups, the main strap or the decorating strap; and a light emitter, disposed on the decorating strap and electrically connected with the power supplier through the photosensitive switch.

2. The circumaural earphone according to claim 1, wherein the light emitter is electrically connected with the power supplier through the manual switch.

3. The circumaural earphone according to claim 1, wherein the light emitter is an electroluminescent element or a light-emitting diode (LED).

4. The circumaural earphone according to claim 1, wherein the power supplier is disposed on one of the earphone cups, and connection between the decorating strap and the earphone cups or connection between the decorating strap and the main strap forms electrical connection between the light emitter and the power supplier.

5. The circumaural earphone according to claim 1, wherein sensitivity of the photosensitive switch is adjustable.

6. A decorating strap of a circumaural earphone, comprising:

a decorating strap, having two ends employed to detachably connected with two earphone cups or a main strap of the circumaural earphone;

a photosensitive switch, disposed on the decorating strap;

a power supplier, disposed on the decorating strap;

a manual switch, wherein the photosensitive switch is electrically connected with the power supplier through the manual switch; and a light emitter, disposed on the decorating strap and electrically connected with the power supplier through the photosensitive switch.

7. The decorating strap according to claim 6, wherein the light emitter is electrically connected with the power supplier through the manual switch.

8. The decorating strap according to claim 6, wherein the light emitter is an electroluminescent element or an LED.

9. The decorating strap according to claim 6, wherein sensitivity of the photosensitive switch is adjustable.

* * * * *